US005201206A

United States Patent [19]

Russo

[11] Patent Number: 5,201,206

[45] Date of Patent: Apr. 13, 1993

[54] CONTINUOUS WIRE DRAWING PROCESS WITH MECHANICAL DESCALING AND POST-DIE TREATMENT AND APPARATUS

[76] Inventor: Anthony J. Russo, 950 Schweitzer Pl., North Brunswick, N.J. 08902

[21] Appl. No.: 920,516

[22] Filed: Jul. 28, 1992

Related U.S. Application Data

[63] Continuation of Ser. No. 754,455, Sep. 3, 1991, abandoned.

[51] Int. Cl.[5] ..... B21B 45/02

[52] U.S. Cl. ..... 72/40; 72/42; 72/282

[58] Field of Search ..... 72/34, 40, 41, 42, 43, 72/44, 45, 282

[56] References Cited

U.S. PATENT DOCUMENTS

| | | | |
|---|---|---|---|
| 1,470,374 | 10/1923 | Boley | 72/282 |
| 2,109,312 | 2/1938 | Dimmick | 72/282 |
| 2,319,393 | 5/1943 | Epstein et al. | 72/42 |
| 2,804,196 | 8/1957 | Planett | 72/41 |
| 3,081,524 | 3/1963 | Ballentine et al. | 72/40 |
| 3,354,687 | 11/1967 | Mauson | 72/282 |
| 3,841,126 | 10/1974 | Minami et al. | 72/45 |
| 4,091,651 | 5/1978 | Rose et al. | 72/40 |

FOREIGN PATENT DOCUMENTS

| | | | |
|---|---|---|---|
| 0206516 | 12/1982 | Japan | 72/44 |
| 0034605 | 2/1987 | Japan | 72/40 |
| 0233008 | 9/1989 | Japan | 72/41 |
| 1639821 | 4/1991 | U.S.S.R. | 72/282 |

*Primary Examiner*—Lowell A. Larson
*Assistant Examiner*—Michael J. McKeon
*Attorney, Agent, or Firm*—Kenneth P. Glynn

[57] ABSTRACT

The present invention is a process for drawing and forming a bright wire of a predetermined diameter and cross-section, from stock of a greater diameter. It includes the steps of (a) continuously feeding said stock from a supply spool through the process; (b) mechanically removing scale from said stock; (c) applying a coating of lubricant carrier to the descaled stock; (d) applying drying air to the stock with the lubricant carrier thereon; (e) applying a lubricant to the carrier-coated stock; (f) drawing the lubricated stock through one or more pressure dies to decrease the diameter of the stock down to the desired predetermined diameter; (g) buffing the drawn stock with a plurality of buffing wheels, said buffing wheels being applied to the drawn stock at a plurality of angles to the direction of travel of the stock to produce bright wire; and, (h) coiling the resulting bright wire into coils for subsequent use. The process is continuous and the speed of the stock is maintained by conventional drive mechanisms to feed into the process and to coil off the process at predetermined speeds. In one embodiment, mechanical removal of scale includes the following steps: (i) bending the stock in at least three different directions over small enough arcs to cause peeling of scale; (ii) abrading of the stock to remove any remaining scale; and, (iii) rinsing the stock to remove any dust resulting from descaling. The present invention also includes the apparatus for the process.

18 Claims, 2 Drawing Sheets

CONTINUOUS WIRE DRAWING PROCESS WITH MECHANICAL DESCALING AND POST-DIE TREATMENT AND APPARATUS

BACKGROUND OF THE INVENTION

This is a continuation application of U.S. patent application Ser. No. 754,455, filed Sep. 3, 1991, now abandoned.

FIELD OF THE INVENTION

The present invention is directed to a bright wire draw process and apparatus. The process and apparatus include mechanical scale removal before pressure die drawing and buffing after drawing. Higher speeds and more efficient production is achieved.

PRIOR ART STATEMENT

The commerce of bright wire production has been active for decades and the end use of bright wire is very diverse. Metal hangers, nails, medical devices, axles, pins, shafts, rods, hooks, etc., are fabricated from bright wire, to name a few. The broad based market for bright wire includes carbon steel, alloy steel and stainless steel, as well as others.

Historically, metal stock, sometimes called hot rolled wire or rod, is manufactured from molten metal and subsequently reworked or sold for reworking into different sizes (and shapes). These stock rolls have been stretched or drawn into lesser diameters, for example, through pressure dies, and have been pretreated to remove scale or oxides, and have been lubricated to prevent rapid wear of the dies. Typically, pretreatment for scale removal involved the use of acid baths, and, even today, production facilities may utilize a batch type pickling process for descaling whereby cranes or hoists physically dip rolls of stock into and out of large heated vats of acid and rinse water and dryers. This descaling operation is costly due to labor needs, it requires large floor space and expensive equipment is slow, creates long down times for bath changes and may cause pollution problems such as spent acid disposal and acid evaporation.

Some of the very modern facilities for drawing bright wire utilize continuous instead of batch processes, but the wire must be traversed back and forth over pulleys in the baths to provide adequate bath and rinse times. Further, spent acid, evaporation, floor space and other problems remain even though the batch method is supplanted by continuous flow methods.

Additionally, bright wire production is achieved by the descaling, drawing and brightening of the wire product. This brightening is accomplished by control of limited or no lubrication to the wire as it passes through its final draw (smallest, last die). The friction of the die scrapes or otherwise removes any coatings and yields a bright product. While this method is acceptable industry wide, it does cause wear and frequent replacement of the final die and requires substantial power to pull the stock through the die by overcoming the intentional frictional drag.

These problems stated have not been addressed or overcome by the industry or prior art until the present invention. For example, good continuous draw technology which in many respects may be today's standard, is exemplified by the 1923 patent to Ernst Boley as U.S. Pat. No. 1,470,374. This patent describes the state of the art, except for perhaps computerized or modern speed control systems, but these are not the subject of the present invention. In the Boley method, three or four baths are utilized, including an acid bath and the problems pertaining thereto as discussed above are not eliminated.

To minimize problems of wire resting in acid baths during down time, e.g. die changes, etc., the art teaches the use of an intermediate wire collecting and feeding device as shown in U.S. Pat. No. 3,354,687 to Walter Mauson. While this patent issued more than 40 years after Boley, it confirms the continuing use of acid baths for descaling.

SUMMARY OF THE PRESENT INVENTION

The present invention is directed to a process for drawing and forming a bright wire of a predetermined diameter and cross-section, from stock of a greater diameter. The process includes the steps of (a) continuously feeding said stock from a supply spool through the process; (b) mechanically removing scale from said stock; (c) applying a coating of lubricant carrier to the descaled stock; (d) applying drying air to the stock with the lubricant carrier thereon; (e) applying a lubricant to the carrier-coated stock; (f drawing the lubricated stock through one or more pressure dies to decrease the diameter to the desired predetermined diameter; (g) buffing the drawn stock with a plurality of buffing wheels, said buffing wheels being applied to the drawn stock at a plurality of angles to the direction of travel of the stock to produce bright wire; and, (h) coiling the resulting bright wire into coils for subsequent use. The process is continuous and the speed of the stock is maintained by conventional drive mechanisms to feed into the process and to coil off the process at predetermined speeds. In one preferred embodiment of the process, mechanical removal of scale includes the following steps: (i) bending the stock in at least three different directions over small enough arcs to cause peeling of scale; (ii) abrading of the stock to remove any remaining scale; and, (iii) rinsing the stock to remove any dust resulting from descaling. The present invention also includes the apparatus for the process.

BRIEF DESCRIPTION OF THE DRAWINGS

The present invention is more fully understood when the description herein is taken in conjunction with the drawings appended hereto. In the drawings.

DETAILED DESCRIPTION OF THE INVENTION

The present invention involves bright wire drawing and especially to improvements both prior to the stock entering the dies and after the stock is drawn through the dies.

It is an object of the present invention to eliminate acid baths and to avoid related pollution and waste disposal problems. It's also an important object of the present invention to minimize pressure die wear and replacement and to provide for decreased energy and costs downstream from the draw through the dies.

Figure 1:
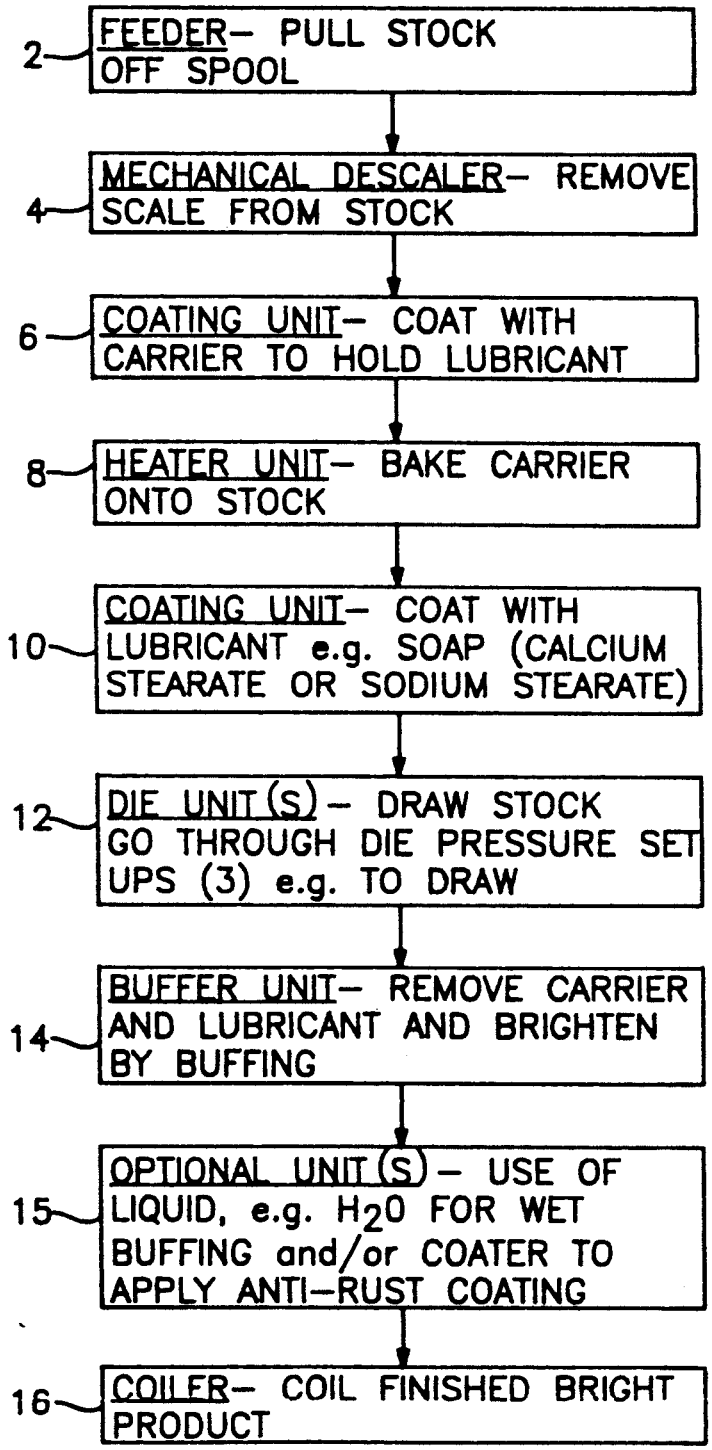
FIG. 1 shows a block diagram of the present invention process and the arrangement of units in the apparatus of the present invention; and, FIG. 2 shows a block diagram of a preferred embodiment of the present invention.

Referring now to FIG. 1, hot rolled stock, e.g. alloy steel, is fed from feeder 2 of its spool to mechanical descaler 4. Here, the scale or metal oxide is removed mechanically instead of by acid bath. Generally, this mechanical scaling requires bending of the stock in a plurality of directions. In order to maximize the effect, the stock should move in a path of arcs wherein the arcs are of small enough diameter to stress the stock adequately for the scale to break away or chip off the stock. In a preferred embodiment, this is followed by abrading and then cleaning of the stock, e.g. rinse, air, wipe or combination.

As the stock is moved down the line by conventional motor driven systems used in pressure die drawing, the descaled stock is next coated with a lubricant carrier at coating unit 6. This is to hold lubricant on the stock for the draw through the dies. Any available lubricant carrier may be used, such as sodium borate, lye, lime or other alkali composition.

Next, the carrier is dried or "baked" onto the stock at heating unit 8 and then, at coating unit 10, the stock is coated with a lubricant, e.g. by solution flow over the moving stock or by gravity feed and/or mechanically assisted feed of powder or particulate lubricant. Such lubricants are typically soap, calcium stearate or sodium stearate or the like.

The stock moves next through one or more pressure dies having final diameters of decreasing size. Typical cross sections are circular, but other die configurations are possible and these are known in the field. In preferred embodiments, additional lubricant is applied before each die to decrease drag and increase efficiency and ease of draw.

A critical step is now applied to the drawn wire, at buffer unit 14. Here, the product is buffed with a plurality of buffers. These preferably run at diverse angles, one or more being at an angle oblique to the direction of flow of the wire. The brushes may also traverse back and forth slightly to reduce wearing one spot on the brushes. Adequate buffing is applied to remove any remaining lubricant and carrier and to enhance the brightness of the finished product.

Normally, this is dry buffing. However, as shown at optional units 15, the buffing may be wet buffing (i.e. including application of a liquid, e.g. water) and/or the buffing may be followed by a coater unit to apply an anti-rust coat, e.g. an oil, to the bright wire product.

Coiler unit 16 runs continuously to coil the finished product for subsequent shipping or use.

Figure 2:
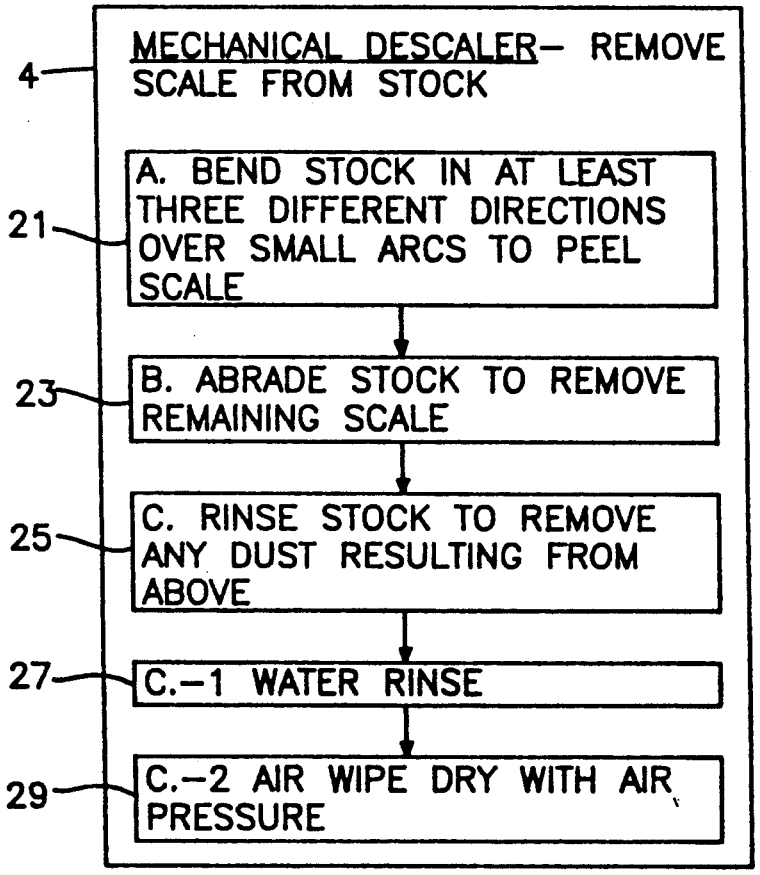

FIG. 2 shows one preferred embodiment of the present invention with respect to mechanical descaling. The mechanical descaler 4 of FIG. 2 is the same generically as that shown in FIG. 1 and would be included in the overall present invention process and apparatus as shown in FIG. 1. Thus, FIG. 2 depicts in block form one set of preferred substeps for the invention shown in FIG. 1. Step A, block 21, shows bending the stock in at least three different directions over small arcs to peel the scale. This may be accomplished by reels, rollers or pulleys or drums, although pulleys afford good control and provide stability with no sideways sliding or movement of the stock as it passes over. The arcs may be, for example, formed from a pulley of a five or six inch diameter, given stock of, for example, one half inch diameter. In fact, the pulley could be smaller or larger and still effect peeling, except that turns through very large arcs, e.g. approaching diameters of half or more of the feed spool, would be ineffective.

Next, at block 23, step B, the stock is abraded to remove remaining scale. The abrasion is accomplished with a plurality of abrading wheels, e.g. wire brushes, and these are preferably set at different angles to the line of travel of the stock.

In step C, block 25, the stock is rinsed to remove dust and dislodged scale. As shown in step C-1, block 27, the rinse in this embodiment is a water rinse. In other embodiments, mechanical wipers, air blasts, etc., could be used, but water rinse is desired. Also, as shown in block C-2, step 29, a pressurized air wipe is used to remove any water remaining after the rinse.

Referring now to both FIGS. 1 and 2, the preferred embodiment steps shown in FIG. 2 are followed by the subsequent steps shown in FIG. 1. Further, preferred embodiments include the hot buffing and the anti-rust coating steps shown as optional units 15 in FIG. 1.

Obviously, numerous modification and variations of the present invention are possible in light of the above teachings. It is therefore understood that within the scope of the appended claims, the invention may be practiced otherwise than as specifically described herein.

What is claimed is:

1. A process for drawing and forming a bright wire of a predetermined diameter and cross section from stock of a greater diameter, which comprises, in sequence:

(a) continuously feeding said stock from a supply spool through the process;

(b) mechanically removing substantially all of the scale from said stock by bending the stock in at least three different directions over small enough arcs to cause peeling of scale and subsequent treatment by abrading the stock;

(c) apply a coating of lubricant carrier to the descaled stock;

(d) applying drying air to the stock with the lubricant carrier thereon;

(e) applying a lubricant to the carrier coated stock, said lubricant being selected from the group consisting of soap, calcium stearate or sodium stearate;

(f) drawing the lubricated stock through a plurality of sequential pressure dies and each sequential die has a final diameter less than that of any die preceding it to decrease the diameter to the desired predetermined diameter and applying a coating of lubricant carrier, applying drying air and lubricating the stock in sequence before each die;

(g) buffing the drawn stock with a plurality of buffing wheels, said buffing wheels being applied to the drawn stock at a plurality of angles to the direction of travel of the stock to produce bright wire; and (h) coiling the resulting bright wire into coils for subsequent use;

wherein all of the steps in the aforesaid process are continuous, and the speed of the stock is maintained by conventional drive mechanisms to feed into the process and to coil off the process at predetermined speeds.

2. The process of claim 1 wherein said plurality of dies are in a straight line draw sequence.

3. The process of claim 1 wherein said mechanical removal of scale includes the following steps:

(i) bending the stock in at least three different directions over small enough arcs to cause peeling of scale;

(ii) abrading of the stock to remove any remaining scale; and, (iii) rinsing the stock to remove any dust resulting from descaling.

4. The process of claim 3 wherein said abrading is accomplished with a plurality of wire brushes set a pre-selected angles to the path of travel of said stock.

5. The process of claim 3 wherein said rinsing includes water rinsing and pressurized air wiping.

6. The process of claim 1 wherein said buffing in step (g) is a dry buffing step.

7. The process of claim 1 wherein said buffing in step (g) is a wet buffing step.

8. The process of claim 1 wherein after said buffing in step (g) and prior to coiling, the stock is coated with a rust resistant oil coating.

9. An apparatus for continuous drawing and forming of a bright wire of a predetermined diameter and cross section from stock of a greater diameter, including conventional drive mechanisms for maintaining the speed of the stock entering, passing through and exiting said apparatus comprising the following units, in sequence, (a) a mechanical descaler, comprising a plurality of bending means for bending stock over arcs in different directions to cause removal of scale;

(b) a lubricant carrier feed mechanism for applying a lubricant carrier to the stock;

(c) a heater unit for applying drying air to the stock with the lubricant carrier thereon;

(d) a powder lubricant feed mechanism for applying a lubricant to the stock;

(e) a plurality of pressure die units, each having a final diameter less than that of any preceding dies and a lubricant carrier feed mechanism, a heater unit and a lubricant feed mechanism in sequence located before each pressure die unit;

(f) a buffer mechanism including a plurality of buffers for removing any carrier and lubricant from the stock and for buffing and brightening the stock; and, (g) a coiler to wind resulting bright wire.

10. The apparatus of claim 9 wherein said plurality of pressure die units are in a straight line draw sequence.

11. The apparatus of claim 9 wherein said bending means comprises a plurality of pulleys arranged sequentially at different angles and having diameters small enough to have arcs of travel for said stock which are capable of causing scale to peel from said stock, followed in sequence by an abrading mechanism downstream and adjacent to said bending means, followed in sequence by rinsing means downstream and adjacent to said abrading mechanism.

12. The apparatus of claim 11 wherein said abrading mechanism comprises a plurality of wire brushes set at pre-selected angles to the path of travel of said stock.

13. The apparatus of claim 11 wherein said rinsing means includes water rinsing means and pressurized air wiping means.

14. The apparatus of claim 9 wherein said buffer mechanism is a dry buffing means.

15. The apparatus of claim 14 which further includes anti-rust oil coating means located after and adjacent to said dry buffing means.

16. The apparatus of claim 9 wherein said buffer mechanism is a wet buffing means.

17. The apparatus of claim 16 which further includes anti-rust oil coating means located after and adjacent to said wet buffing means.

18. The apparatus of claim 9 which further includes anti-rust oil coating means located after said buffer mechanism and before said coiler.

* * * * *